US006944886B1

(12) United States Patent
Jackson

(10) Patent No.: US 6,944,886 B1
(45) Date of Patent: Sep. 20, 2005

(54) EAR PROTECTORS AND METHOD OF MANUFACTURE THEREOF

(76) Inventor: Linnie Jackson, 11490 Harwin, No. 413, Houston, TX (US) 77072

( * ) Notice: Subject to any disclaimer, the term of this patent is extended or adjusted under 35 U.S.C. 154(b) by 123 days.

(21) Appl. No.: 10/384,466

(22) Filed: Mar. 7, 2003

(51) Int. Cl.[7] ..... A42B 1/06
(52) U.S. Cl. ..... 2/209
(58) Field of Search ..... 2/174, 209

(56) References Cited

U.S. PATENT DOCUMENTS 1,619,772 A * 3/1927 Thompson ..... 2/174
2,070,332 A * 2/1937 Dowling et al. ..... 2/174
2,570,675 A * 10/1951 Morris ..... 128/866
2,763,869 A * 9/1956 Bogart et al. ..... 2/174
3,144,663 A * 8/1964 McKinstry ..... 2/209
3,452,365 A * 7/1969 Wallace ..... 2/209
4,308,623 A 1/1982 Voorhees
4,660,229 A 4/1987 Harris
4,916,758 A 4/1990 Jordan-Ross
4,935,965 A * 6/1990 Wassell ..... 2/209
5,778,455 A 7/1998 Joseph
5,920,912 A 7/1999 Patchett
6,041,440 A 3/2000 Jackson
6,298,493 B1 10/2001 Ambroise

* cited by examiner

*Primary Examiner*—Katherine M. Moran
(74) *Attorney, Agent, or Firm*—Kenneth A. Roddy

(57) ABSTRACT

Soft flexible generally ovate pouch-like ear protectors formed of a single sheet of chemically resistant and moisture impervious or heat insulative material shaped similar a human ear that protect the ear from heat and harsh chemicals and moisture during hair treatment operations, and their method of manufacture are disclosed. The protectors have a stretchable resilient opening for placement over the external ear, a larger top end portion that accommodates the helix of the ear and taper downwardly to a smaller bottom end portion that accommodates the lobule of the ear. In one embodiment, the protectors have a radially outward flared skirt portion surrounding the opening to prevent harsh chemicals, moisture and hair dye from contacting the ears and delicate skin area around the ears. In another embodiment the protectors insulate and protect the ears from heat generated by hair dryers and electric straightening/curling irons. Pairs of each embodiment may be provided as a kit.

5 Claims, 5 Drawing Sheets

EAR PROTECTORS AND METHOD OF MANUFACTURE THEREOF

BACKGROUND OF THE INVENTION

1. Field of the Invention

This invention relates generally to ear protectors and covers, and more particularly to soft flexible ear protectors for protecting the ears from heat and/or harsh liquid chemicals and moisture during hair treatment operations, and the method of manufacturing the same.

2. Brief Description of the Prior Art

Hair grooming and cleansing operations are a necessary part of life. The process may be as simple as washing an individual's hair or may become more elaborate requiring the use of chemicals and/or heat. Hair cleansing and treating operations may very often include the use of liquids such as water and other moisturizer as well as chemicals and dyes. Some dyes can stain the ears or surrounding skin if allowed to come into contact with the skin surfaces. The process may also require the use of hair drying devices, which generate heat. The use of the liquids as well as the hair drying devices can very often result in some discomfort to the individual. One of the more common discomforting experiences for an individual is discomfort to the ears during these procedures. It is not unusual to receive painful burns to the ear because of the harsh liquid chemicals used for treatment of the hair as well as because of the heat that is generated by the hair dryers and or hair straightening/curling irons used during the process.

Many ethnic populations and persons with naturally curly hair often utilize a hair straightening process to produce a smoother texture and straighter appearance. The first commercial hair straightening products were based on sodium hydroxide. While the amount of sodium hydroxide in the products has decreased over the years, the chemistry involved, and the methodology used has changed little over the years. There are basically two types of hair straightening products currently available in the U.S. cosmetic market. The first type or class are those based on a caustic "lye" formulation. The products in this class are sometimes labeled as "lye" or "no lye". The lye based products contain the active ingredient sodium hydroxide. This chemical is very alkaline and is the same ingredient contained in drain cleaners. Other products in this class are referred to as "no lye" but only contain a different positive cation with hydroxide producing the same class of alkali chemical. The most common are calcium hydroxide and potassium hydroxide. Calcium hydroxide is often used in plaster and cement, while potassium hydroxide can be extremely corrosive. These formulas are commonly used in the commercially available hair straighteners bought for home use. As strong alkali products, these formulations can cause severe burns and are very hazardous to skin, scalp and mucus membranes, and especially the ears. These products carry specific label warnings to avoid contact with the skin.

The second class of products, originally developed from permanent wave solutions, are ammonium thioglycolate based, often referred to as "thio" straighteners or "perms". These products are also alkaline and are most commonly used by professional beauticians. Without careful use by a professional, these products can be a depilatory in addition to causing severe bums, and are also hazardous to skin, scalp, and especially the ears.

There are a number of ear protecting devices in the prior art. However these devices do not necessarily address all of the concerns necessary to protect an individual's ears from heat and from harsh chemicals during the hair treating process.

Voorhees, U.S. Pat. No. 4,308,623 discloses a protective enclosure for the human ear that is entirely closed except for a single opening sized to receive the outer ear. The opening is surrounded by a band of pressure sensitive adhesive to anchor the enclosure to the skull in a fluid tight manner. The opposite lateral edges of the enclosure are pleated inwardly to receive the operator's fingers in areas closely spaced to the adhesive while installing the enclosure over the ear.

Harris, U.S. Pat. No. 4,660,229 discloses a water-tight ear enclosure having a water-impervious membrane secured to a flexible, inelastic J-shaped strip about a portion of an opening in the membrane and an elastic strip secured to opposite ends of the flexible, inelastic strip and to the remaining portions of the opening in the membrane. The flexible, inelastic strip includes an adhesive for attaching the strip to the skin of a person adjacent the ear.

Jordan-Ross, U.S. Pat. No. 4,916,758 discloses a disposable full ear protector for beautician use during applications of liquid treatments which may irritate or otherwise cause discomfort to the ear flesh or outer ear canal, wherein the ear canal is protected by a plug while a full ear cover surrounds the ear proper. Absorbent materials on the inside of the ear cover and associated in and with the plug ensure that no unwanted liquids may contact the ear to any significant extent.

Joseph, U.S. Pat. No. 5,778,455 discloses an ear cover for protecting the external ear of a wearer. The cover includes a first flexible sheet having an outer layer formed of an absorbent paper and an inner layer coextensive therewith formed of an impermeable plastic material. A second flexible sheet of absorbent paper is secured to the first flexible sheet adjacent the inner layer to serve as a liner for the cover. An elastic band is secured between the first and second flexible sheets for gathering the respective peripheries thereof around the ear of a wearer.

Patchett, U.S. Pat. No. 5,920,912 discloses a pair of ear cuffs comprising a left and right member, connected by string or elastic to prevent the members from being lost and/or separated from each other. The each ear cuff is of double layer construction formed of an outer layer of heat-resistive material such as Teflon™ and an inner layer formed of soft material such as cotton cloth.

My previous patent, U.S. Pat. No. 6,041,440, which is hereby incorporated herein by reference, is directed toward a molded ear protector that provides a waterproof and heat sealed environment surrounding the ear and has an aperture that aligns with the ear canal and a plug for sealing the aperture. The present invention has significant differences and advantages over my U.S. Pat. No. 6,041,440.

Ambroise, U.S. Pat. No. 6,298,493 discloses an ear protector dimensioned and configured to be secured over the user's ear, protecting the ear from the harmful effects of hot curling irons and blow dryers. The ear protector has a three layer construction having a cotton fiber or cotton fabric exterior, a Teflon™ or similar type material located in the center and a cotton or soft batting in the interior. An elastic band is secured to both the inner covering and outer covering adjacent to the stitching and secures the ear protector over the user's ear. Alternatively, a drawstring can be used in place of the elastic band to secure the ear protector over the user's ear.

The present invention is distinguished over the prior art in general, and these patents in particular by soft flexible generally ovate pouch-like ear protectors formed of a single sheet of material shaped similar a human ear that protect the ears from heat and harsh liquid chemicals and moisture during hair treatment operations, and their method of manufacture. The protectors have a stretchable resilient opening for placement over the external ear, a larger top end portion that accommodates the helix of the ear and taper downwardly to a smaller bottom end portion that accommodates the lobule of the ear. In one embodiment, the protectors are formed of chemically resistant and moisture impervious material and have a radially outward flared skirt portion surrounding the opening to prevent harsh chemicals, moisture and hair dye from contacting the ears and delicate skin area around the ears. In another embodiment the protectors are formed of heat insulative material to insulate and protect the ears from the heat that is generated by hair dryers and electric straightening/curling irons. Pairs of each embodiment may be provided as a kit.

SUMMARY OF THE INVENTION

It is therefore an object of the present invention to provide soft flexible ear protectors that protect the ears from heat and harsh liquid chemicals and moisture during hair treatment operations.

It is another object of this invention to provide a kit having a first pair of soft flexible ear protectors having a radially outward flared skirt portion that protect the ears and surrounding skin from harsh liquid chemicals and moisture and a second pair of the ear protectors that protect the ears from heat generated by hair dryers and electric straightening or curling irons during hair treatment operations.

Another object of this invention is to provide soft flexible generally ovate pouch-like ear protectors that are formed of a single sheet of material shaped similar a human ear.

Another object of this invention is to provide a method of manufacturing soft flexible ear protectors from a single sheet of material.

Another object of this invention is to provide an ear protector kit for use by professional hairdressers or individuals at home for protecting the ears and surrounding skin from harsh liquid chemicals and moisture and for protect the ears from heat generated by hair dryers and electric straightening or curling irons during hair treatment operations.

A further object of this invention is to provide soft flexible ear protectors that are attractive in appearance.

A still further object of this invention is to provide soft flexible generally ovate pouch-like ear protectors that are simple in construction, inexpensive to manufacture and safe and reliable in use.

Other objects of the invention will become apparent from time to time throughout the specification and claims as hereinafter related.

The above noted objects and other objects of the invention are accomplished by the present soft flexible generally ovate pouch-like ear protectors formed of a single sheet of material shaped similar a human ear that protect the ears from heat and/or harsh liquid chemicals and moisture during hair treatment operations, and their method of manufacture. The protectors have a stretchable resilient opening for placement over the external ear, a larger top end portion that accommodates the helix of the ear and taper downwardly to a smaller bottom end portion that accommodates the lobule of the ear. In one embodiment, the protectors are formed of chemically resistant and moisture impervious material and have a radially outward flared skirt portion surrounding the opening to prevent harsh chemicals, moisture and hair dye from contacting the ears and delicate skin area around the ears. In another embodiment the protectors are formed of heat insulative material to insulate and protect the ears from the heat that is generated by hair dryers and electric straightening/curling irons. Pairs of each embodiment may be provided as a kit.

DESCRIPTION OF THE PREFERRED EMBODIMENTS

Figure 1:
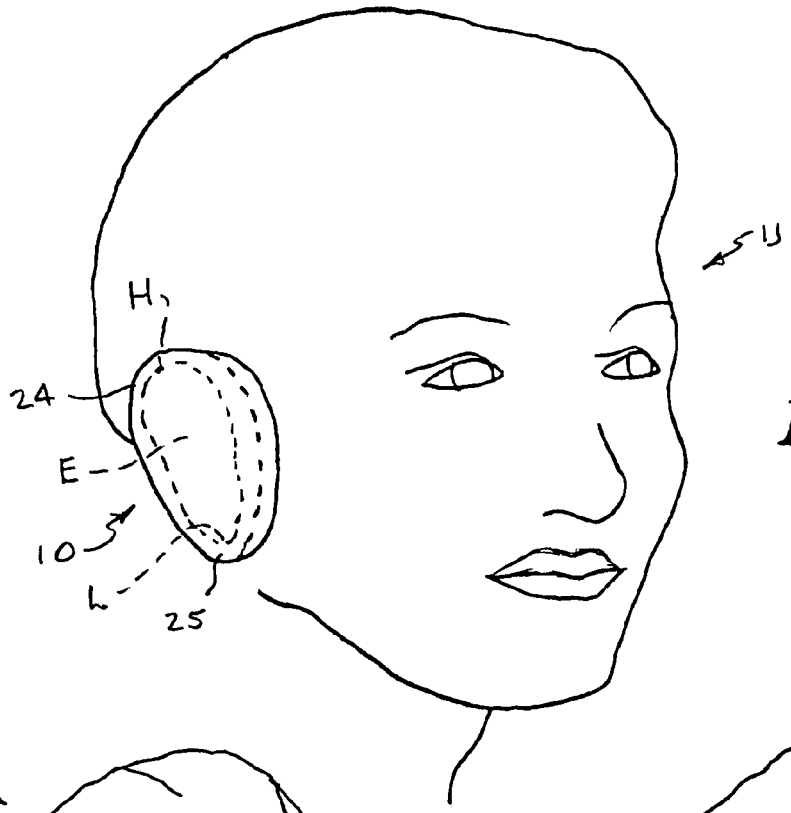
FIG. 1 is a perspective view of a first embodiment of the ear protector shown positioned on the ear of a user.

Referring to the drawings by numerals of reference, there is shown in FIG. 1, a first preferred embodiment of the ear protector 10, in accordance with the present invention, positioned on the ear E of a user U. In this embodiment the ear protector 10 is formed of a single layer of soft flexible heat insulative material, such as fleece or cotton and serves to insulate and protect the wearer's ears from the heat that is generated by hair dryers and/or electric straightening/curling irons used during the hair treatment process.

Figure 2:
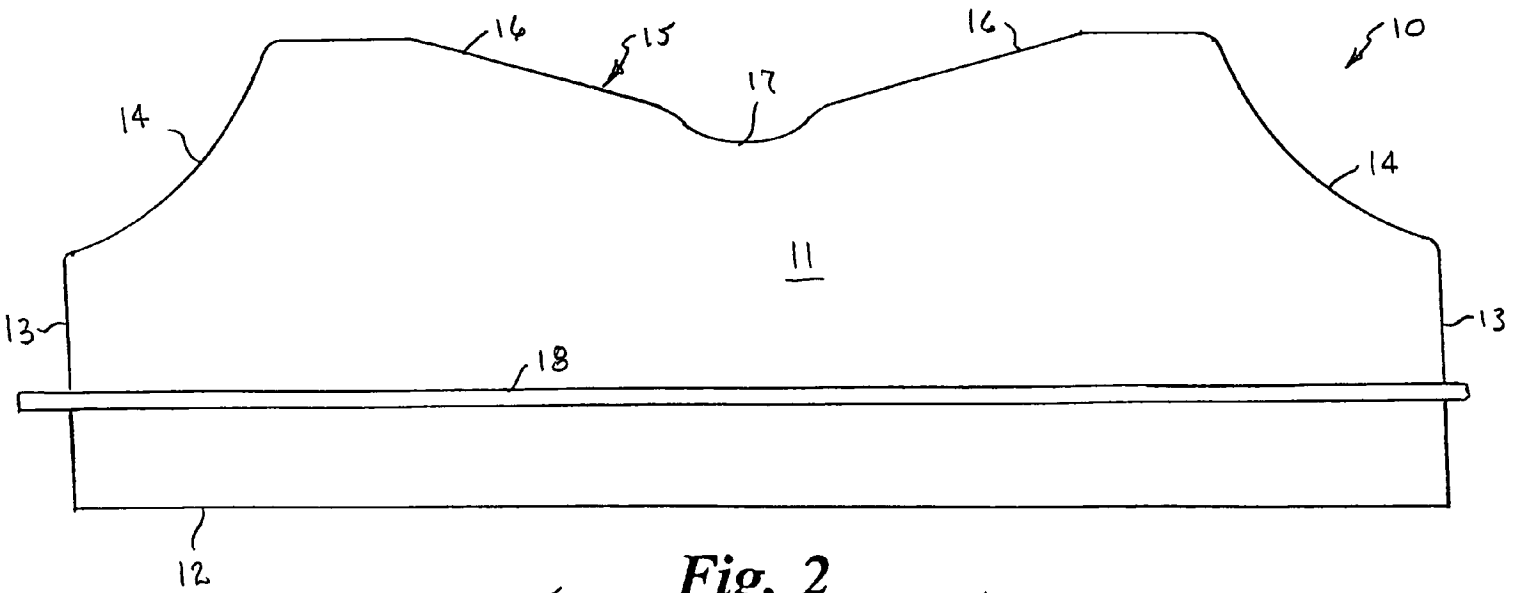
FIGS. 2, 3 and 4 are elevation views illustrating the process of forming the ear protector of FIG. 1.
Figure 3:
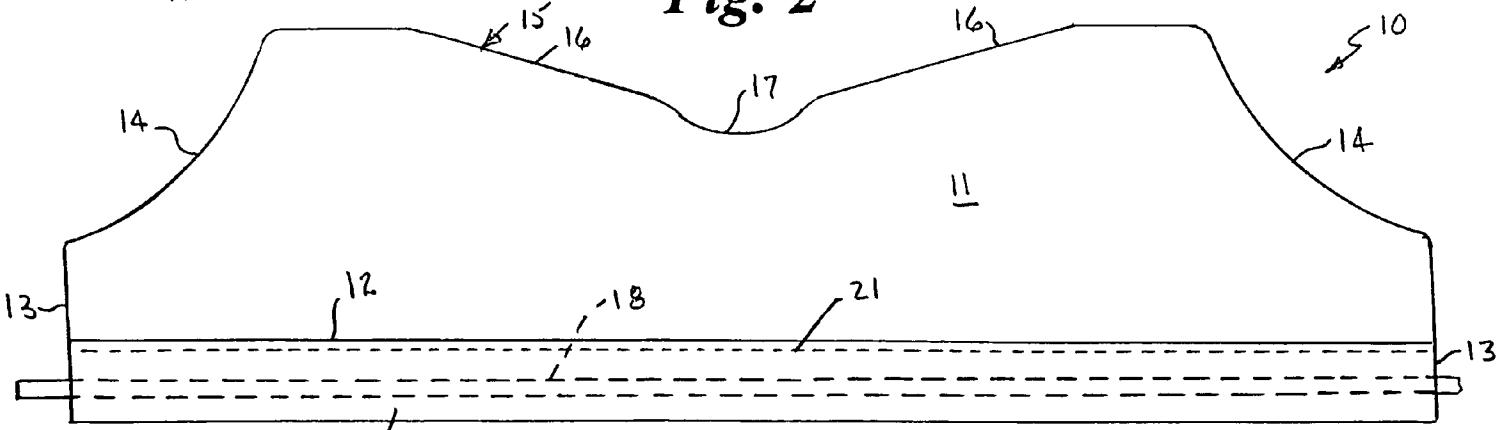

As shown in FIGS. 2 and 3, the ear protector 10 is formed from a single piece of material 11 cut to form a straight longitudinal bottom edge 12, a pair of laterally opposed straight side edges 13 extending a distance vertically upward therefrom, and a pair of laterally opposed arcuate inwardly curved side portions 14 above the straight side edges 13. The piece of material 11 is cut to form a top edge 15 having outer portions 16 that extend laterally inwardly and angularly downward from the top ends of the laterally opposed arcuate inwardly curved side portions 14 and converge at the center in an arcuate inwardly curved portion 17.

An elastic band 18 in a stretched condition is placed on the material 11 to extend between the laterally opposed straight side edges 13 generally parallel with the straight longitudinal bottom edge 12 and a distance thereabove approximately one-half the length of the vertical length of the straight side edges (FIG. 2). The straight longitudinal bottom edge 12 is then folded over the elastic band 18 and secured to the material 11, for example by stitching 21, to form a hem 22 enclosing the elastic band along its length (FIG. 3).

Figure 4:
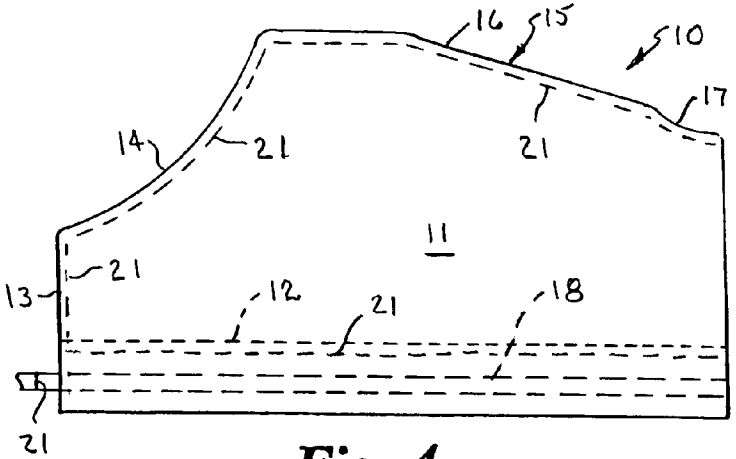

As shown in FIG. 4, the material 11 is then folded in half about its vertical center such that the straight side edges 13, arcuate inwardly curved side portions 14, and angularly converging outer portions 16 are superposed. The superposed straight side edges 33 above the hem 22, the arcuate inwardly curved side portions 14 and angularly converging outer portions 16 are then secured together, for example by stitching 21. The outer ends of the elastic band 18 are secured together, for example by stitching 21 and the excess length is cut off. The folded and stitched material 11 is then turned inside out such that the stitching is on the inside.

Figure 5:
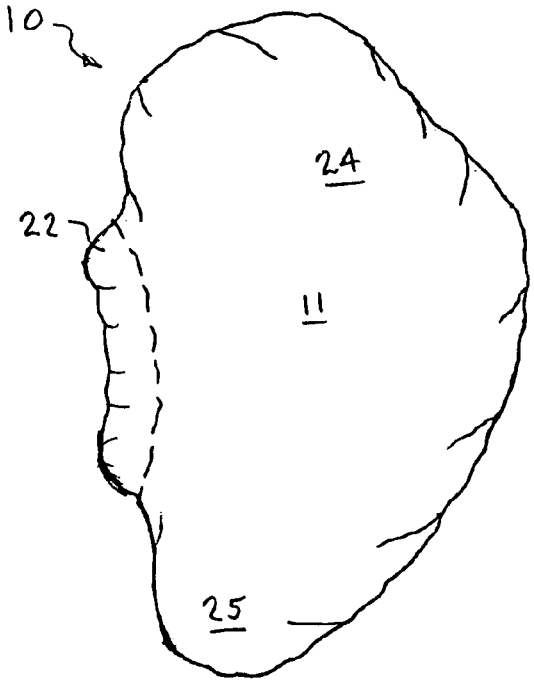
FIG. 5 is a side elevation view of the ear protector of FIG. 1.
Figure 6:
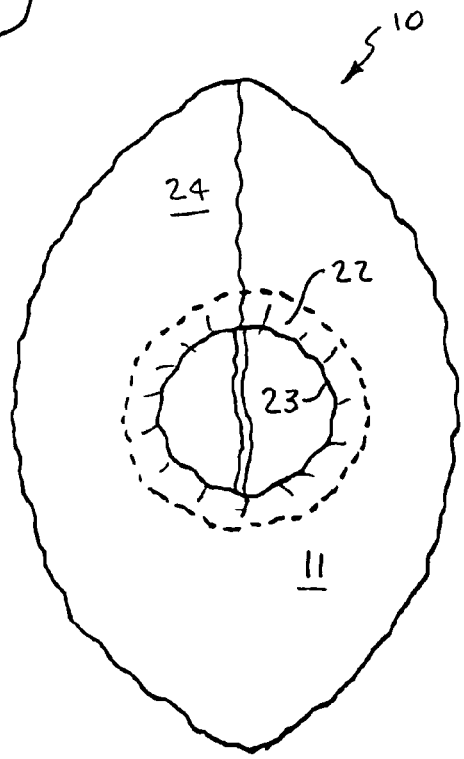
FIG. 6 is a front elevation view of the ear protector of FIG. 1.

As shown in FIGS. 5 and 6, the elastic band gathers the hemmed bottom edge 12 of the ear protector 10 into a generally circular stretchable elastic opening 23 and the material forms a pouch having a generally ovate configuration. As seen in FIG. 1 and from the side in FIG. 5, the particular shapes of the superposed straight side edges, arcuate inwardly curved side portions, and angularly converging outer portions cause the outer periphery of the ear protector 10 to assume a shape closely following the shape of the human ear. That is to say, the ear protector 10 has a larger top end portion 24 which accommodates the helix H of the ear E (the curved upper portion of the ear) and tapers downwardly to a smaller bottom end portion 25 which accommodates the lobule L of the ear (the ear lobe at the bottom of the ear).

Figure 7:
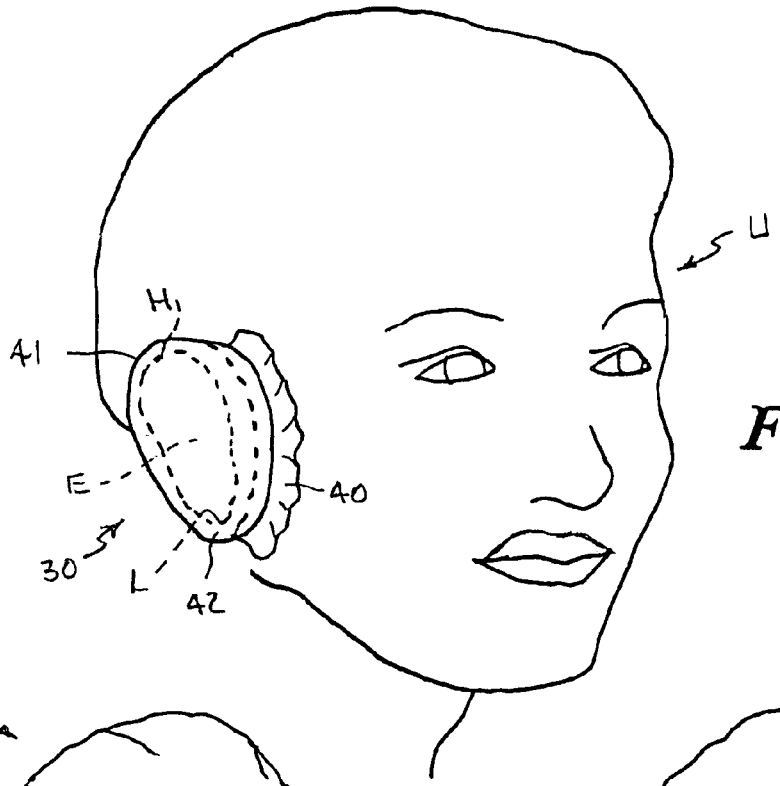
FIG. 7 is a perspective view of a second embodiment of the ear protector shown positioned on the ear of a user.

Referring now to FIG. 7, a second preferred embodiment of the ear protector 30, in accordance with the present invention, is shown positioned on the ear E of a user U. In this embodiment the ear protector 30 is formed of a single layer of flexible chemically resistant and moisture impervious material, such a suitable plastic, and serves to prevent moisture and harsh chemicals from contacting the delicate skin tissue of the ear and the skin immediately surrounding the ear during the hair treatment process.

Figure 8:
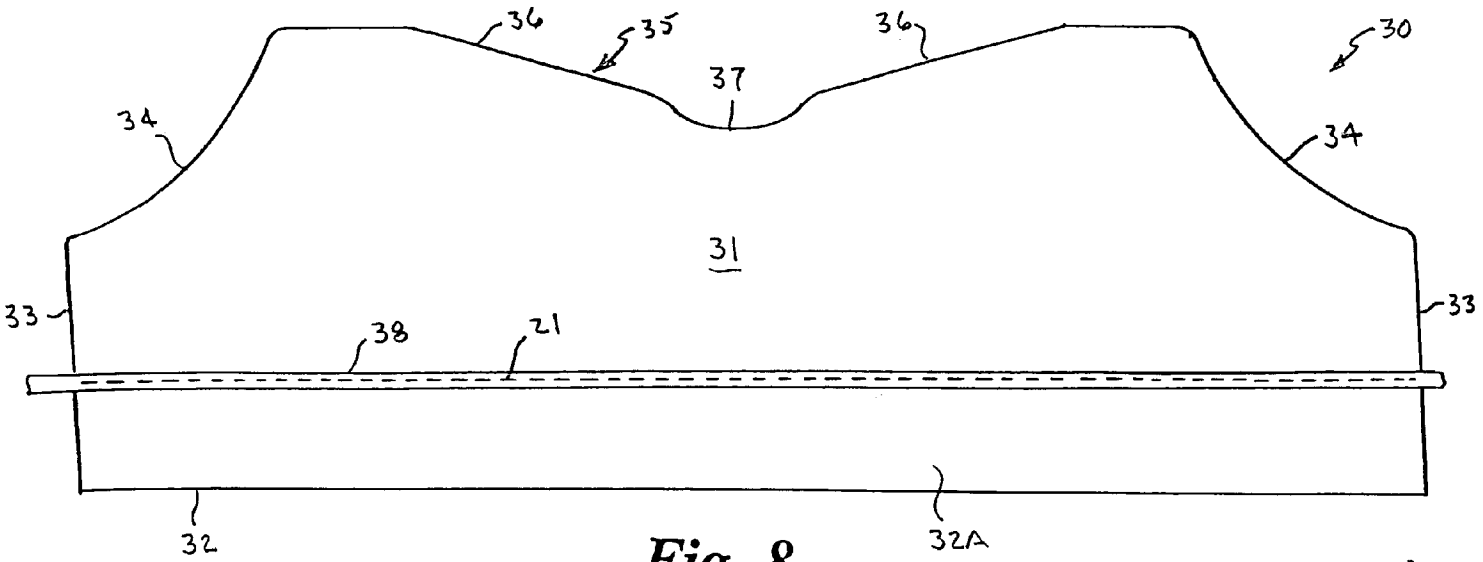
FIGS. 8 and 9 are elevation views illustrating the process of forming the ear protector of FIG. 7.
Figure 9:
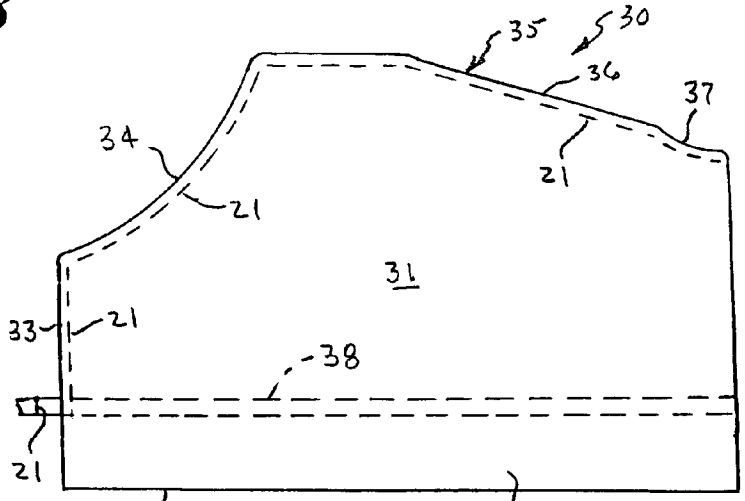

As shown in FIGS. 8 and 9, the ear protector 30 is formed from a single piece of material 31 cut to form a straight longitudinal bottom edge 32, a pair of laterally opposed straight side edges 33 extending a distance vertically upward therefrom, and a pair of laterally opposed arcuate inwardly curved side portions 34 above the straight side edges 33. The piece of material 31 is cut to form a top edge 35 having outer portions 36 that extend laterally inwardly and angularly downward from the top ends of the laterally opposed arcuate inwardly curved side portions 34 and converge at the center in an arcuate inwardly curved portion 37.

An elastic band 38 in a stretched condition is secured, for example by stitching 21, to the material 31 to extend between the laterally opposed straight side edges 33 generally parallel with the straight longitudinal bottom edge 32 and a distance thereabove approximately one-half the length of the vertical length of the straight side edges (FIG. 8). In this embodiment, the straight longitudinal bottom edge 32 is not folded over the elastic band to form a hem. Instead, the portion 32A beneath the elastic band 38 having a vertical length approximately one-half the vertical length of the straight side edges 33 is left free.

As shown in FIG. 9, the material 31 is then folded in half about its vertical center such that the straight side edges 33, arcuate inwardly curved side portions 34, and angularly converging outer portions 36 are superposed. The superposed straight side edges 33 above the elastic band 38, the arcuate inwardly curved side portions 34 and angularly converging outer portions 36 are then secured together, for example by stitching 21. The outer ends of the elastic band 38 are secured together, for example by stitching 21 and the excess length is cut off. The folded and stitched material 31 is then turned inside out such that the stitching is on the inside.

Figure 10:
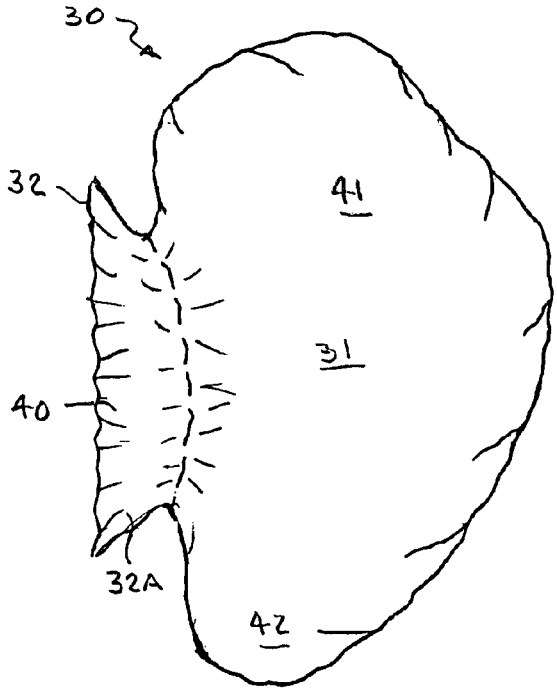
FIG. 10 is a side elevation view of the ear protector of FIG. 7.
Figure 11:
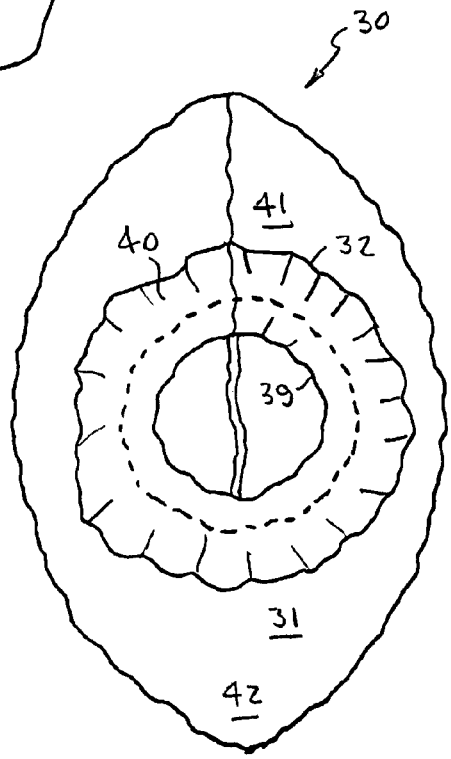
FIG. 11 is a front elevation view of the ear protector of FIG. 7.

As shown in FIGS. 10 and 11, the elastic band 38 gathers the bottom portion of the ear protector 30 into a generally circular stretchable elastic opening 39 and the material forms a pouch having a generally ovate configuration. When the elastic band 38 gathers the bottom portion of the ear protector 30 to form the opening 39, the free portion 32A beneath the elastic band 38 having a vertical length approximately one-half the vertical length of the straight side edges 33 becomes flared radially outward from the opening and forms a skirt 40 surrounding the opening.

As seen in FIG. 7 and from the side in FIG. 10, the particular shapes of the superposed straight side edges, arcuate inwardly curved side portions, and angularly converging outer portions cause the outer periphery of the ear protector 30 to assume a shape closely following the shape of the human ear. That is to say, the ear protector 30 has a larger top end portion 41 which accommodates the helix H of the ear E (the curved upper portion of the ear) and tapers downwardly to a smaller bottom end portion 42 which accommodates the lobule L of the ear (the ear lobe at the bottom of the ear). The outwardly flared skirt 40 surrounding the opening covers the skin area immediately surrounding the ear to prevent harsh chemicals, moisture and hair dyes from contacting the delicate area around the ear.

Although the straight side edges above the hem, and the arcuate inwardly curved side portions and angularly converging outer portions have been described as being secured together by stitching, it should be understood that other conventional means may be used, such as adhesive, glue, heat bonding, etc.

Figure 12:
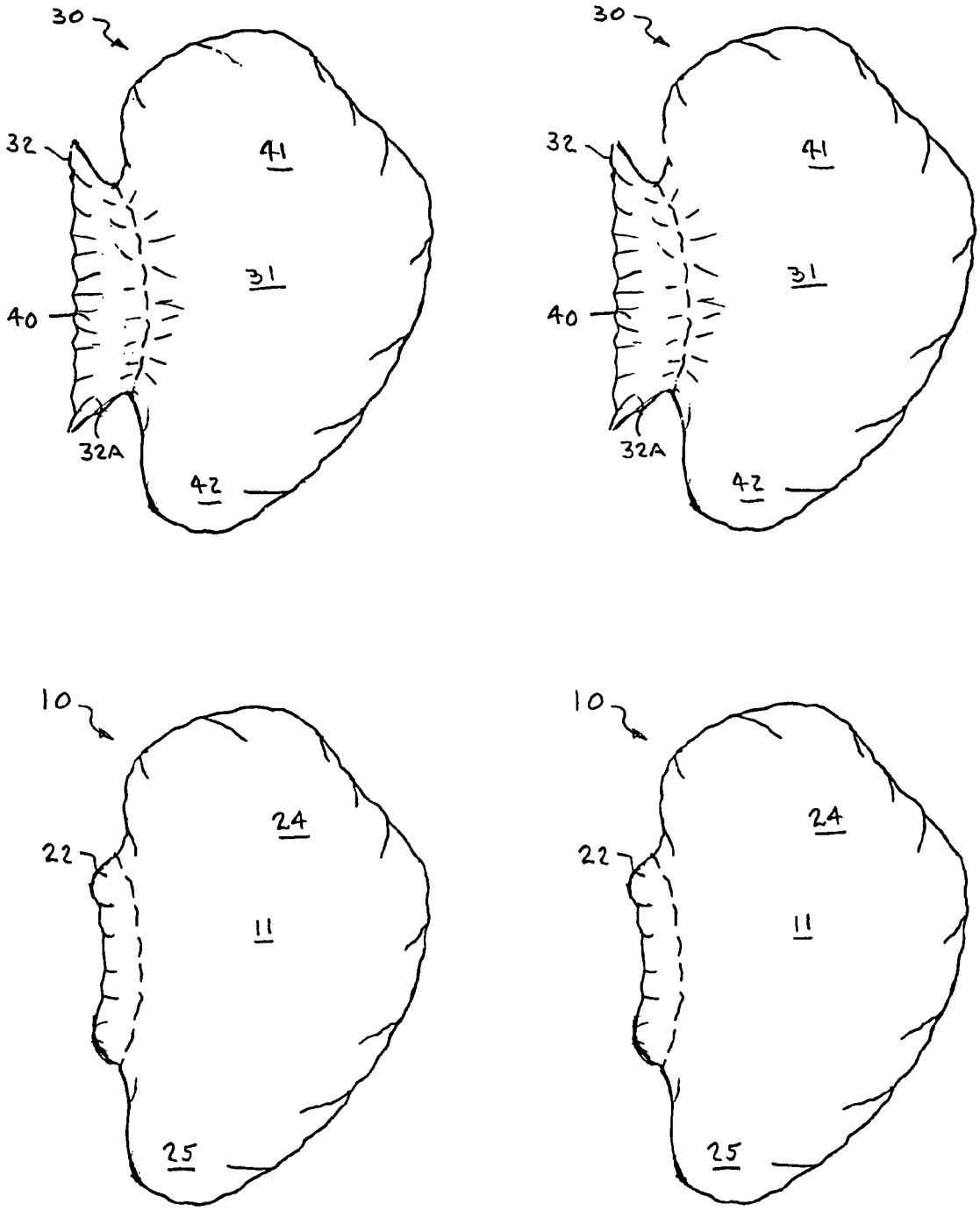
FIG. 12 is a side elevation of a pair of the first embodiment and a pair of the second embodiment of the ear protectors provided as a kit.

The first and second embodiments of the ear protectors 10 and 30 are each preferably provided in pairs, and pairs of the first and second embodiments of the ear protectors may be provided as a kit for hair treatment operations, as shown in FIG. 12. Thus, the kit would provide a first pair of ear protectors 30 formed of chemically resistant and moisture impervious material for preventing harsh chemicals, moisture and hair dye from contacting the delicate skin tissue of the wearer's ears and the skin immediately surrounding the ears during applications of liquids, harsh chemicals and hair dyes, and a second pair of ear protectors 10 formed of soft flexible heat insulative material for insulating and protecting the wearer's ears from the heat that is generated by hair dryers and/or electric straightening/curling irons used during the process.

While this invention has been described fully and completely with special emphasis upon preferred embodiments, it should be understood that within the scope of the appended claims the invention may be practiced otherwise than as specifically described herein.

What is claimed is:

1. An ear protection kit for protecting the external ears of a human during hair treatment processes, comprising:

a pair of first flexible generally ovate pouch-like covers, each formed of a single sheet of chemically resistant and moisture impervious material shaped similar to a human ear and having a stretchable resilient opening for placement over the external ear, and an outwardly flared skirt portion surrounding said opening and extending radially outward therefrom, and each of said first pouch-like protective covers having a larger top end portion that accommodates the helix of the ear and tapering downwardly to a smaller bottom end portion that accommodates the lobule of the ear, and said outwardly flared skirt portion surrounding said opening covering the skin area immediately surrounding the ear;

said first covers being worn on the ears to prevent harsh chemicals, moisture and hair dye from contacting the delicate skin area around the ear; and a pair of second flexible generally ovate pouch-like protective covers, each formed of a single sheet of thermally insulating material shaped similar to a human ear and having a stretchable resilient opening for placement over the external ear, each of said second pouch-like protective covers having a larger top end portion that accommodates the helix of the ear and tapering downwardly to a smaller bottom end portion that accommodates the lobule of the ear; and said second covers being worn on the ears to insulate and protect the external ears from the heat that is generated by hair dryers and electric straightening/curling irons used during the hair treatment process.

2. A pouch-like protective cover formed of a single sheet of material for protecting the external ear of a human;

said single sheet of flexible material cut to form a straight longitudinal bottom edge, a pair of laterally opposed straight side edges extending a distance vertically upward therefrom, a pair of laterally opposed arcuate inwardly curved side portions above said straight side edges, and a top edge having outer portions that extend laterally inwardly and angularly downward from top ends of said laterally opposed arcuate inwardly curved side portions and converge in an arcuate inwardly curved portion;

said bottom edge folded over an elastic band in a stretched condition and secured to said sheet of material to form a hem substantially enclosing said elastic band;

said sheet of material folded in half such that said straight side edges, said arcuate inwardly curved side portions, and said angularly converging outer portions are superposed, and said superposed straight side edges above said hem, said arcuate inwardly curved side portions, and said angularly converging outer portions secured together, and outer ends of said elastic band secured together; and said folded and secured sheet of material being turned inside out to form a pouch having a generally ovate configuration with all seams on the inside thereof; wherein said elastic band substantially enclosed in said hem forms a generally circular stretchable elastic opening on one side of said pouch, and the shapes of said superposed straight side edges, arcuate inwardly curved side portions, and angularly converging outer portions cause said pouch to assume a shape closely following the shape of a human ear, said pouch having a larger top end portion for accommodating the helix of the ear and tapering downwardly to a smaller bottom end portion for accommodating the lobule of the ear.

3. The pouch-like protective cover according to claim 2, wherein said single sheet of material is formed of thermally insulating material for insulating and protecting the external ear from heat that is generated by hair dryers and electric straightening/curling irons used during a hair treatment process.

4. A pouch-like protective cover formed of a single sheet of material for protecting the external ear of a human;

said single sheet of flexible material cut to form a straight longitudinal bottom edge, a pair of laterally opposed straight side edges extending a distance vertically upward therefrom, a pair of laterally opposed arcuate inwardly curved side portions above said straight side edges, and a top edge having outer portions that extend laterally inwardly and angularly downward from top ends of said laterally opposed arcuate inwardly curved side portions and converge in an arcuate inwardly curved portion;

an elastic band in a stretched condition secured to said sheet of material parallel with said bottom edge and a distance therefrom to form a free lower portion beneath said elastic band;

said sheet of material folded in half such that said straight side edges, said arcuate inwardly curved side portions, and said angularly converging outer portions are superposed, and said superposed straight side edges above said elastic band, said arcuate inwardly curved side portions, and said angularly converging outer portions secured together, and outer ends of said elastic band secured together; and said folded and secured sheet of material being turned inside out to form a pouch having a generally ovate configuration with all seams on the inside thereof; wherein said elastic band forms a generally circular stretchable elastic opening on one side of said pouch, said free lower portion beneath said elastic band is flared radially outward from said opening to form a skirt surrounding said opening, and the shapes of said superposed straight side edges, arcuate inwardly curved side portions, and angularly converging outer portions cause said pouch to assume a shape closely following the shape of a human ear, said pouch having a larger top end portion for accommodating the helix of the ear and tapering downwardly to a smaller bottom end portion for accommodating the lobule of the ear, and said skirt extending radially outward from said opening to cover the skin surfaces immediately surrounding the external ear.

5. The pouch-like protective cover according to claim 4, wherein said single sheet of material is formed of chemically resistant and moisture impervious material for preventing harsh chemicals, moisture and hair dye from contacting the external ear and the delicate skin area around the ear during a hair treatment process.

* * * * *